US009441389B2

(12) United States Patent
Shiomi et al.

(10) Patent No.: US 9,441,389 B2
(45) Date of Patent: Sep. 13, 2016

(54) METHOD FOR CONSTRUCTING CYLINDRICAL TANK

(71) Applicant: IHI Corporation, Tokyo (JP)

(72) Inventors: Hiroshi Shiomi, Tokyo (JP); Satoru Nagumo, Tokyo (JP); Norio Uchiyama, Tokyo (JP); Noriyuki Katsuyama, Tokyo (JP); Masaki Takahashi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 14/435,827

(22) PCT Filed: Jun. 28, 2013

(86) PCT No.: PCT/JP2013/067867

§ 371 (c)(1),
(2) Date: Apr. 15, 2015

(87) PCT Pub. No.: WO2014/073240

PCT Pub. Date: May 15, 2014

(65) Prior Publication Data

US 2015/0267434 A1 Sep. 24, 2015

(30) Foreign Application Priority Data

Nov. 12, 2012 (JP) ..... 2012-248554

(51) Int. Cl.

| | |
|---|---|
| ***E04H 7/06*** | (2006.01) |
| ***B65D 88/00*** | (2006.01) |
| ***E04H 5/10*** | (2006.01) |
| ***E04H 7/20*** | (2006.01) |
| ***E04G 21/16*** | (2006.01) |
| ***E04H 7/18*** | (2006.01) |

(52) U.S. Cl.
CPC ..... *E04H 7/06* (2013.01); *E04G 21/163* (2013.01); *E04H 5/10* (2013.01); *E04H 7/065* (2013.01); *E04H 7/18* (2013.01); *E04H 7/20* (2013.01); *F17C 2201/032* (2013.01)

(58) Field of Classification Search
None
See application file for complete search history.

(56) References Cited

U.S. PATENT DOCUMENTS 1,839,578 A * 1/1932 Morton ..... 29/429
1,846,506 A * 2/1932 Wiggins ..... 220/565
2,057,682 A * 10/1936 Horton et al. ..... 220/565

(Continued)

FOREIGN PATENT DOCUMENTS

CN 101784833 A 7/2010
CN 201704994 U 1/2011

(Continued)

OTHER PUBLICATIONS

International Search Report mailed Aug. 13, 2013 in PCT/JP2013/067867.

*Primary Examiner* — Joshua J Michener
*Assistant Examiner* — Kyle Walraed-Sullivan
(74) *Attorney, Agent, or Firm* — Rothwell, Figg, Ernst & Manbeck, P.C.

(57) ABSTRACT

A method of constructing a cylindrical tank that has an inner tank made of metal and an outer tank made of concrete has a step of building a PC wall (3) by erecting lateral liners (4) sequentially from the bottommost layer to the topmost layer on an outer circumferential edge portion of a base plate, and pouring concrete (5) so as to follow the erecting of the lateral liners (4) with the lateral liners (4) being used as an inner side forming frame.

9 Claims, 16 Drawing Sheets

(56) References Cited

U.S. PATENT DOCUMENTS

| | | | | | |
|---|---|---|---|---|---|
| 2,237,308 | A | * | 4/1941 | Larson | 220/653 |
| 2,263,943 | A | * | 11/1941 | Ferguson | 220/565 |
| 2,304,354 | A | * | 12/1942 | Harvey | E04H 7/06 134/30 |
| 2,378,126 | A | * | 6/1945 | Blair | 220/565 |
| 2,378,128 | A | * | 6/1945 | Cates | 217/4 |
| 2,708,012 | A | * | 5/1955 | Talcott | 254/89 R |
| 2,928,565 | A | * | 3/1960 | Glasoe, Jr. | 220/567.2 |
| 2,984,898 | A | * | 5/1961 | Vilhelm | 29/429 |
| 3,018,546 | A | * | 1/1962 | Dewese | 29/431 |
| 3,559,835 | A | * | 2/1971 | Lange | 220/560.12 |
| 3,595,291 | A | * | 7/1971 | Grunhoff et al. | 220/565 |
| 3,701,262 | A | * | 10/1972 | Connell et al. | 62/53.1 |
| 4,062,468 | A | * | 12/1977 | Bongiovanni | 220/567.2 |
| 4,177,915 | A | * | 12/1979 | Blankenburg | 228/184 |
| 4,884,711 | A | * | 12/1989 | Bomhard et al. | 220/565 |
| 5,105,590 | A | * | 4/1992 | Dykmans | 52/745.01 |
| 5,271,193 | A | * | 12/1993 | Olsen et al. | 52/19 |
| 5,287,986 | A | * | 2/1994 | Frost | 220/565 |
| 2008/0302804 | A1 | * | 12/2008 | Simmons et al. | 220/560.05 |
| 2010/0154332 | A1 | * | 6/2010 | Shockley et al. | 52/223.3 |
| 2011/0289865 | A1 | * | 12/2011 | Martens et al. | 52/173.1 |
| 2015/0053692 | A1 | * | 2/2015 | Uchiyama | 220/560.1 |
| 2015/0197953 | A1 | | 7/2015 | Shiomi et al. | |
| 2016/0083957 | A1 | | 3/2016 | Yamada et al. | |
| 2016/0097211 | A1 | | 4/2016 | Deguchi et al. | |

FOREIGN PATENT DOCUMENTS

| | | | |
|---|---|---|---|
| CN | 102003095 | A | 4/2011 |
| JP | 60-184799 | A | 9/1985 |
| JP | 4-370797 | A | 12/1992 |
| JP | 10-8762 | A | 1/1998 |
| JP | 2012-149416 | A | 8/2012 |

* cited by examiner

METHOD FOR CONSTRUCTING CYLINDRICAL TANK

CROSS REFERENCE TO RELATED APPLICATIONS

This application is a 35 U.S.C. 371 National Phase Entry Application from PCT/JP2013/067867, filed Jun. 28, 2013, which claims priority to Japanese Patent Application No. 2012-248554, filed Nov. 12, 2012, the disclosures of which are incorporated herein in their entirety by reference.

TECHNICAL FIELD

The present invention relates to a method for constructing a cylindrical tank.

Priority is claimed on Japanese Patent Application No. 2012-248554, filed Nov. 12, 2012, the contents of which are incorporated herein by reference.

BACKGROUND ART

A cylindrical tank having a structure that includes an inner tank and an outer tank is used to store cryogenic liquids such as LNG (liquefied natural gas) and LPG (liquefied petroleum gas). A method of constructing a cylindrical tank having an inner tank made of metal and an outer tank made of concrete is disclosed in Patent Document 1.

In this method of constructing a cylindrical tank, firstly, a base plate is constructed, and steel liners (i.e., outer tank lateral plates) are then stacked sequentially in layers on top of this base plate and are fixed in position by welding. After the steel liners have been assembled, an outer tank sidewall is constructed by setting up an outer side forming frame, and pouring concrete with the steel liners being used as an inner side forming frame. At the same time, a frame and deck of an outer tank roof are assembled on an inner side bottom portion of the outer tank sidewall, and are then mounted on an apex portion of the outer tank sidewall. Thereafter, the concrete of the outer tank roof is poured and, lastly, the inner tank is assembled. As a result, a cylindrical tank having a function of storing LNG and the like at low temperatures is constructed.

CITATION LIST

Patent Documents

Patent Document 1: United States Unexamined Patent Application Publication No. 2008/0302804

SUMMARY OF INVENTION

Technical Problem

In the above-described conventional technology, because the concrete is poured with the assembled steel liners used as a forming frame, there is a possibility of a portion of the steel liners located at a height where there is no poured concrete being buckled by wind loading. Accordingly, in the above-described conventional technology, it is necessary to increase the plate thickness and the like in order to secure the strength of the steel liners, and it is not possible to optimize the design of the steel liners so that the quantities of materials required for construction can be kept to the necessary minimum.

The present invention was conceived in view of the above-described problem and it is an object thereof to provide a method of constructing a cylindrical tank that makes it possible to limit the quantities of materials required for construction to the necessary minimum while any buckling of the outer tank lateral plates can be prevented.

Solution to Problem

In order to achieve the above-described object, a first aspect of the present invention is a method of constructing a cylindrical tank that has an inner tank made of metal and an outer tank made of concrete includes a step of building a sidewall of the outer tank by erecting outer tank lateral plates sequentially from the bottommost layer to the topmost layer on an outer circumferential edge portion of a bottom portion of the outer tank, and pouring concrete so as to follow the erecting of the outer tank lateral plates with the outer tank lateral plates being used as an inner side forming frame.

In the first aspect of the present invention, because the outer tank lateral plates are erected sequentially from the bottommost layer to the topmost layer, and the concrete is poured so as to follow the erecting of the outer tank lateral plates with the outer tank lateral plates being used as an inner side forming frame, the erecting of the outer tank lateral plates and the pouring of the concrete are parallel tasks that are performed at fixed intervals. As a result of this, because the height of the outer tank lateral plates where the concrete has not yet been poured is restricted to a fixed range, it is possible to prevent any buckling of the outer tank lateral plates due to wind loading. Moreover, because there is no need to increase the plate thickness and the like in order to maintain the strength of the outer tank lateral plates, it is possible to optimize the plate thickness and the like when designing the outer tank lateral plates so that the weight of the materials required for construction is kept to the minimum required.

Moreover, in a second aspect of the present invention, there is provided a step of alternatingly performing a butt-welding of the next outer tank lateral plate onto a top of the outer tank lateral plate which has been erected with the pouring of the concrete up to a height where the concrete covers the butt-welded portion.

In the second aspect of the present invention, the butt-welding of the outer tank lateral plates is performed alternately with the pouring of the concrete, and the concrete is poured following the erecting of each layer of the outer tank lateral plates. By employing this method, the height of the outer tank lateral plates where the concrete has not yet been poured can be restricted to a fixed range, and because the welded portions of the outer tank lateral plates are sequentially covered by the concrete, any buckling of the outer tank lateral plates that is caused by wind loading can be even more reliably prevented.

Moreover, in a third aspect of the present invention there is provided a step of providing a drainage hole that is used to drain water from a gap between the outer tank lateral plates and the concrete in a base end portion of the sidewall of the outer tank.

If the concrete is poured using the outer tank lateral plates as an inner side forming frame, an unpreventable gap is generated by the drying contraction of the concrete between the outer tank lateral plates and the concrete, and there is a possibility that before the outer tank roof is installed, moisture may become accumulated in this gap during the pouring of the concrete, or due to precipitation during wet weather. In contrast to this, in the third aspect of the present invention, by providing a drainage hole in the base end portion of the outer tank sidewall, the flow of water can be properly controlled, and water is allowed to drain away.

Moreover, in a fourth aspect of the present invention there is provided a step of assembling the inner tank by repeating alternatingly the lifting of an inner tank lateral plate using a jack-up unit and the attaching of the next inner tank lateral plate to an underside of the lifted inner tank lateral plate.

In the fourth aspect of the present invention, by lifting inner tank lateral plates using the jack-up units and continuously adding inner tank lateral plates in sequence to the underside of the lifted inner tank lateral plates, this adding of the inner tank lateral plates is performed at a low position. Because of this, the task of assembling the inner tank can be performed safely at a low height while any obstruction from the outer tank roof portion which is being held partway up the outer tank sidewall is avoided.

Moreover, in a fifth aspect of the present invention there are provided: a step of forming in advance an aperture portion in the outer tank lateral plate; a step of mounting an anchor portion, to which an anchor that has been embedded in the concrete is connected, in the aperture portion; and a step of supporting the jack-up unit via the anchor portion mounted in the aperture portion.

In the fifth aspect of the present invention, because the load acting on the jack-up unit is received by the sidewall of the outer tank, the anchor portions are mounted in the aperture portions that have been previously provided in the outer tank lateral plates, and are integrated with the outer tank lateral plates. By employing this structure, it becomes unnecessary to increase the overall plate thickness of the outer tank lateral plates and the like so as to ensure they have sufficient strength to support the jack-up units, and it is thereby possible to secure the necessary anchor points while limiting the plate thickness of the outer tank lateral plates to the required minimum.

In a sixth aspect of the present invention, a toroidal stiffener that protrudes from the outer tank lateral plate towards the inner side of the outer tank lateral plate is provided.

According to the sixth aspect of the present invention, because the outer tank lateral plates are reinforced by providing a stiffener in addition to the reinforcement by pouring of the concrete following the erecting of the outer tank lateral plates, it is possible to more reliably prevent any buckling of the outer tank lateral plates that is caused by wind-loading.

Advantageous Effects of Invention

According to the present invention, a method of constructing a cylindrical tank is obtained that makes it possible to limit the quantities of materials required for construction to the necessary minimum at the same time as it prevents the outer tank lateral plates from buckling.

DESCRIPTION OF EMBODIMENTS

Hereinafter, an example of a method for constructing a cylindrical tank according to the present invention will be described with reference made to the drawings.

Figure 1:
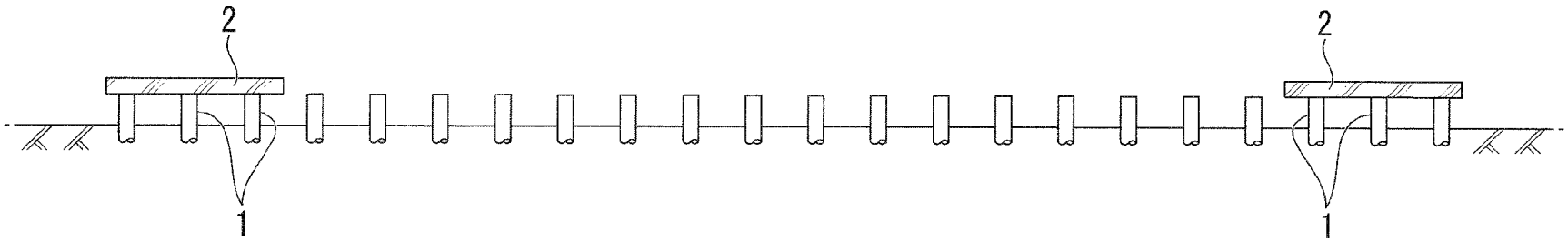
FIG. 1 is a view showing a first step of a construction method according to an embodiment of the present invention.

Firstly, as is shown in FIG. 1, bearing piles 1 are hammered into the ground, and a portion of a base plate (i.e., a bottom portion of an outer tank) 2 is constructed on top of the bearing piles 1. The portion of the base plate 2 that is constructed here is a ring-shaped annular portion that serves as a portion on which the tank sidewall is erected.

Figure 2:
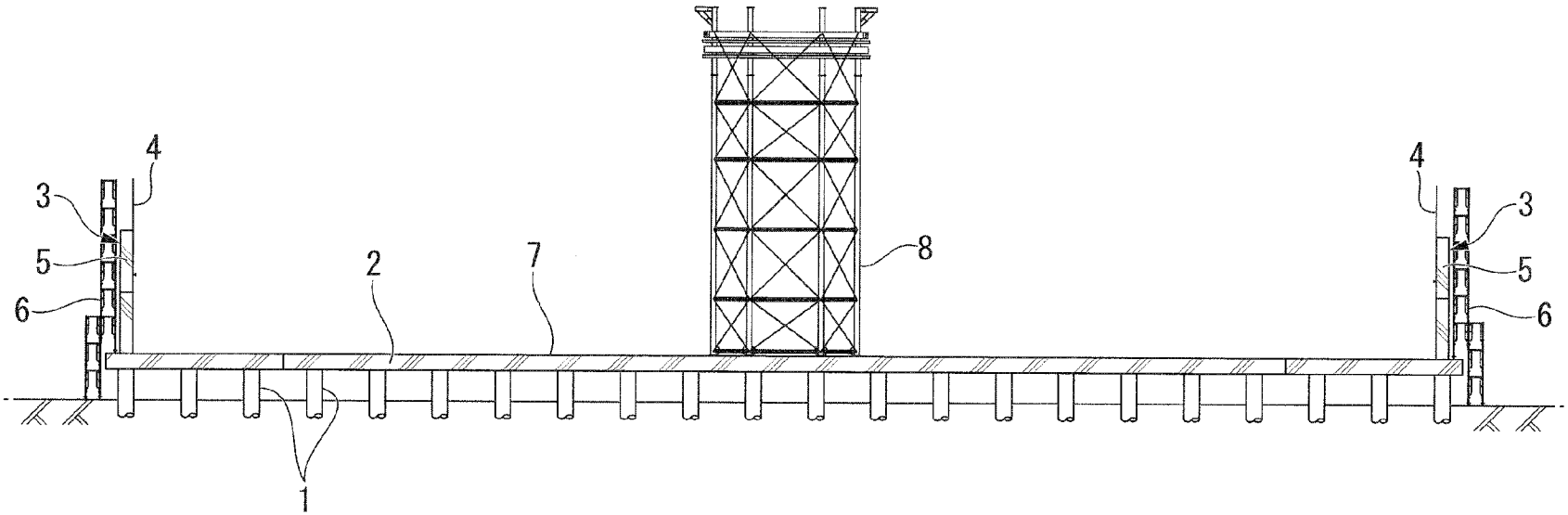
FIG. 2 is a view showing a second step of the construction method according to the embodiment of the present invention.

Next, as is shown in FIG. 2, a PC wall (i.e., an outer tank sidewall) 3 is erected on the annular portion of the previously constructed base plate 2. Specifically, the PC wall 3 is built by erecting lateral liners (i.e., outer tank lateral plates) 4 on top of the base plate 2, and pouring concrete 5 around the outside of the lateral liners 4. The lateral liners 4 are steel liners that also function as concrete forming frames. By causing the concrete 5 to be poured so as to follow the erecting of the lateral liners 4, and installing an external foot scaffold 6, the PC wall 3 is gradually built sequentially from the bottom.

Figure 3:
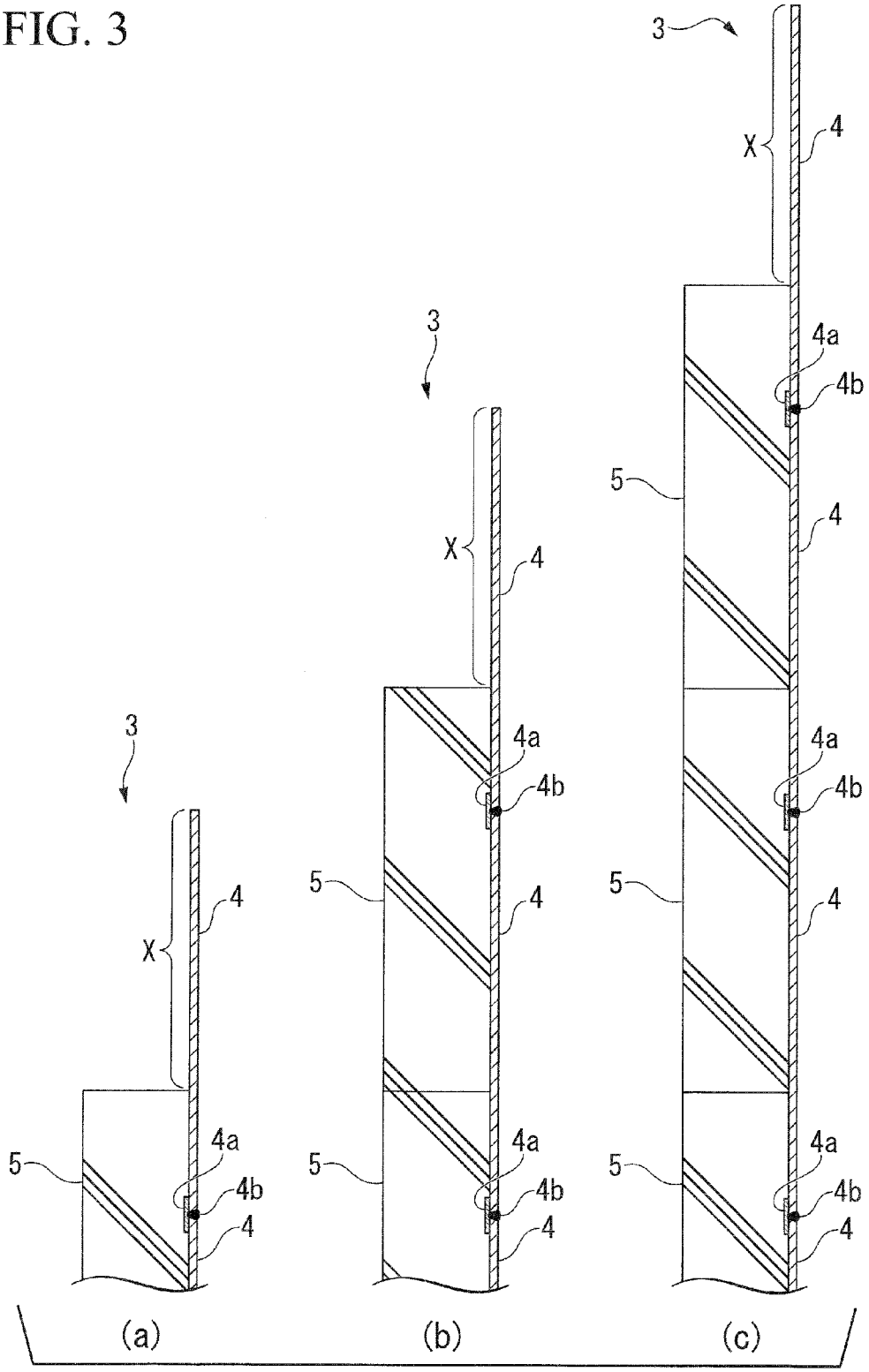
FIG. 3 is a view illustrating a technique for building a PC wall according to the embodiment of the present invention.

Specifically, as is shown in (a) to (c) of FIG. 3, the PC wall 3 is built by first erecting the lateral liners 4, and then alternating the butt-welding of the next lateral liner 4 onto a top edge of the previously installed lateral liner 4 with the pouring of the concrete 5 using the welded lateral liners 4. The butt-welding of the lateral liners 4 is preferably achieved by performing one-side welding from the inside of the tank, and, for example, backing strip butt welding may be performed using a backing metal strip indicated by the symbol 4*a* in FIG. 3. In this manner, by employing one-side welding from the inside of the tank in order to butt-weld the lateral liners 4, it is possible to avoid any obstruction in the task of pouring the concrete 5 outside the tank.

In this technique, the lateral liners 4 are erected in sequence from the bottommost layer to the topmost layer, and the concrete 5 is poured following this erecting with the lateral liners 4 acting as an inner side forming frame (note that the outer side forming frame is not shown). Because of this, as is shown in (a) to (c) in FIG. 3, the erecting of the lateral liners 4 and the pouring of the concrete 5 are parallel tasks that are performed at fixed intervals. As a result, the height of a protruding portion X of the lateral liners 4 where the concrete 5 has not yet been poured can be restricted to a fixed range. Because the protruding portion X is the only portion of each lateral liner 4 that receives wind loading, by restricting the protruding portion X to a fixed range, it is possible to prevent any buckling of the lateral liners 4 due to wind loading.

Moreover, according to this technique, when designing the lateral liners 4 it is possible to design the plate thickness and the like thereof based on the wind loading that is acting on the protruding portion X. Because of this, it is possible to design the lateral liners 4 such that the plate thickness and the like thereof guarantees the required minimum strength to prevent any buckling from the wind loading acting on the protruding portion X. Accordingly, it is possible to optimize the design of the lateral liners so as to minimize the quantities of the materials needed for construction, and to also achieve a reduction in costs and a simplifying of the task when the lateral liners 4 are welded at elevation.

Moreover, in the present embodiment, when the concrete 5 is being poured following the butt welding of the lateral liners 4, as is shown in (a) to (c) in FIG. 3, the concrete 5 is poured to a height where it covers a horizontal weld line 4*b*, which is a portion where the lateral liners 4 are butt-welded together. As a consequence of this, the protruding portion X of the lateral liners 4 where the concrete 5 has not been poured can be made smaller than the vertical width of each lateral liner 4, and even at its maximum can be limited to less than twice this vertical width. Furthermore, because the weld portion of the lateral liners 4 is sequentially covered by the concrete 5, any buckling of the lateral liners 4 that is caused by wind loading can be even more reliably prevented.

Returning to FIG. 2, in parallel with this building of the PC wall 3, the central portion of the base plate 2 on the inner side of the annular portion is constructed and the base plate 2 is thereby completed. Once the base plate 2 has been completed, a bottom portion liner 7 is laid on top of the base plate 2. Thereafter, a roof stand 8 is erected above the central portion of the base plate 2.

Figure 4:
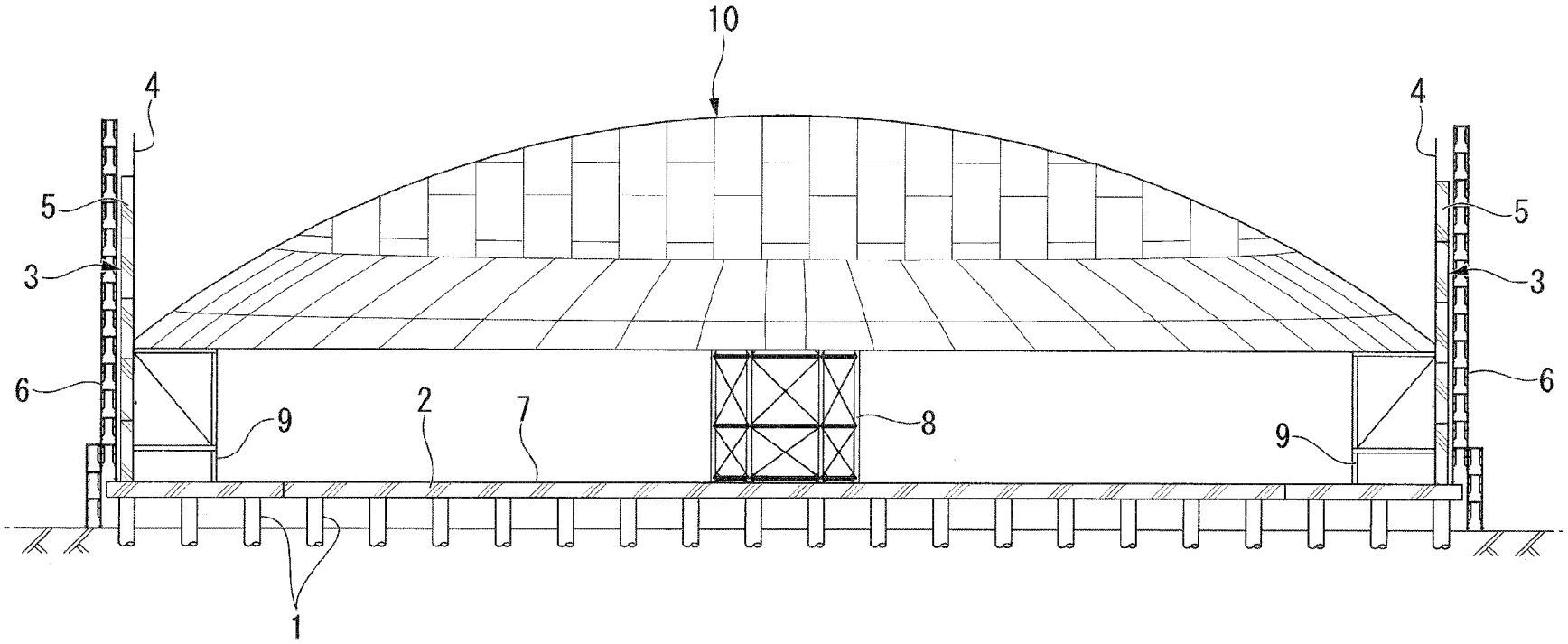
FIG. 4 is a view showing a third step of the construction method according to the embodiment of the present invention.

Next, as is shown in FIG. 4, legged trestles 9 are installed running around the inside of a base end portion of the lateral liners 4. An outer tank roof (i.e., an outer tank roof portion) 10 is then erected on top of the roof stand 8 and the legged trestles 9. The outer tank roof 10 is erected by placing a high-elevation work vehicle or the like on top of the base plate 2, building a steel frame, and mounting roof blocks on top of this steel frame. Because this outer tank roof 10 is erected in an area away from the outer circumferential edge portion of the base plate 2 on which the PC wall 3 is being assembled, there is no interference between the building of the PC wall 3 and the erecting of the outer tank roof 10, and both tasks can be performed as simultaneous parallel tasks.

Figure 5:
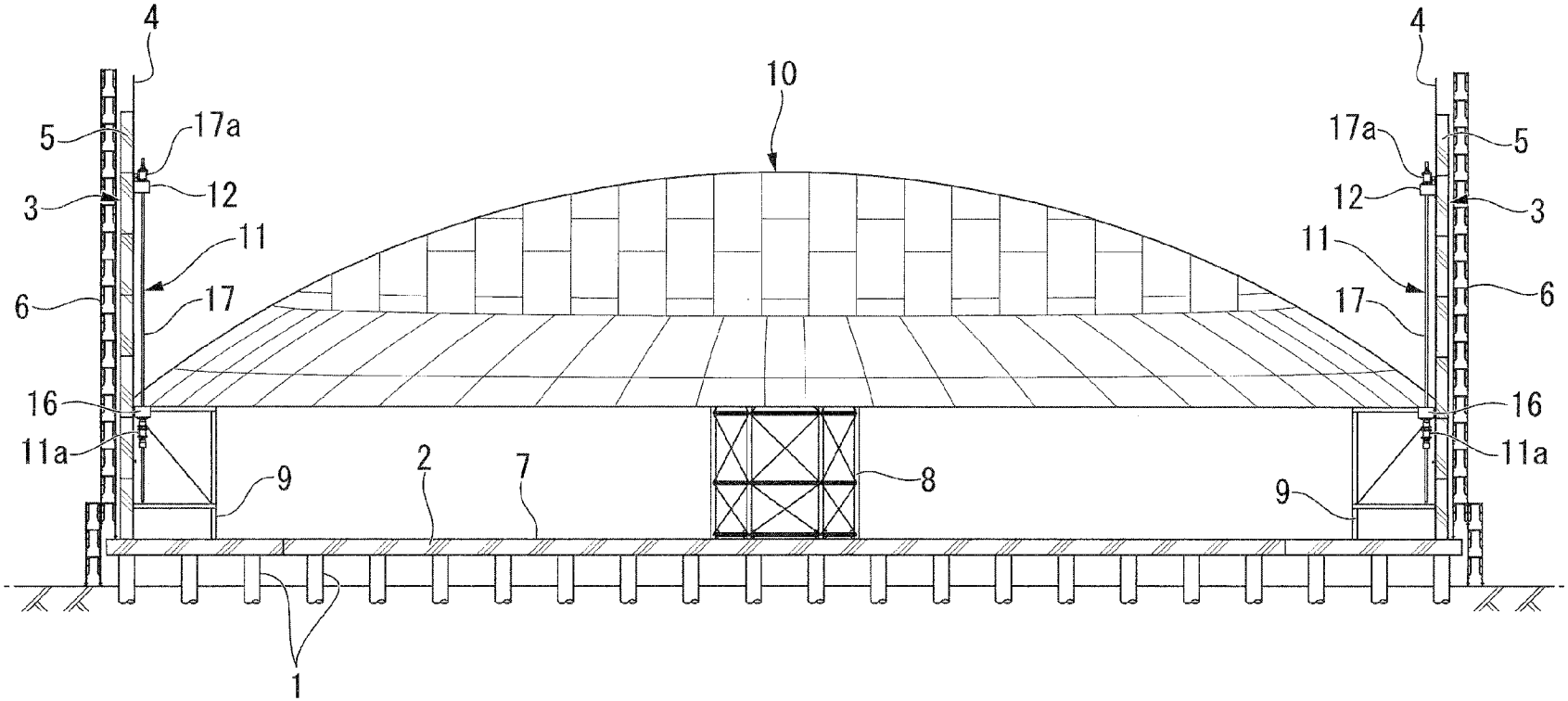
FIG. 5 is a view showing a fourth step of the construction method according to the embodiment of the present invention.
Figure 6:
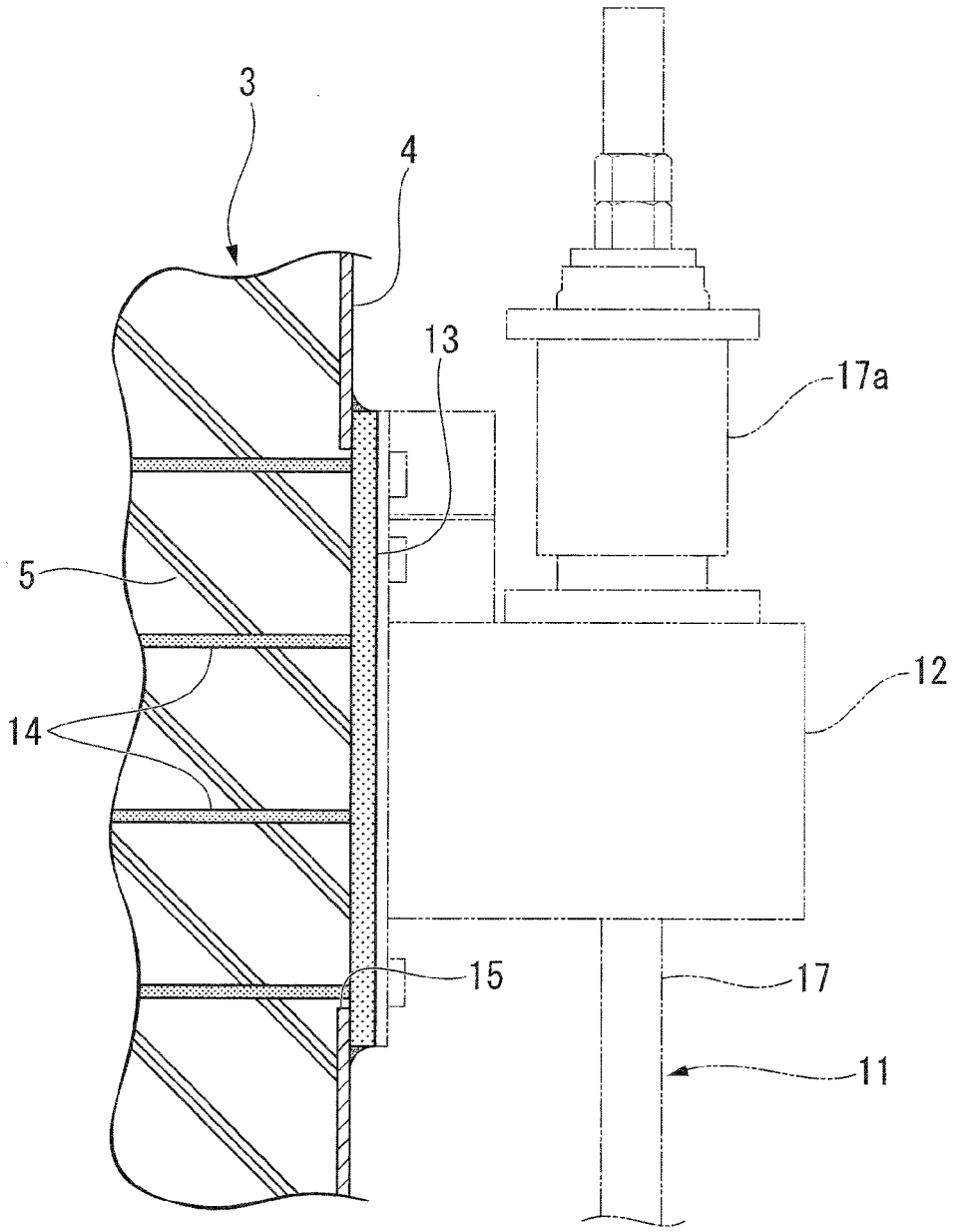
FIG. 6 is a cross-sectional view showing the structure of an anchor plate according to the embodiment of the present invention.

Once the outer tank roof 10 has been erected to a certain stage, next, as is shown in FIG. 5, jack-up units 11 are installed on the PC wall 3 which is in the course of assembly. Firstly, a plurality of hanging-side jack stands (i.e., hanging points) 12 are installed on the PC wall 3 in the tank circumferential direction above the base plate 2 and above the outer circumferential edge portion of the outer tank roof 10. The hanging-side jack stands 12 are installed so as to protrude substantially horizontally towards the inside of the tank from the PC wall 3 at a predetermined height. The hanging-side jack stands 12 are firmly and also removably fixed to anchor plates (i.e., an anchor portions) 13 that are embedded in the PC wall 3 shown in FIG. 6.

The anchor plates 13 have greater strength than the lateral liners 4 as a result of the anchor plates 13 being connected to a plurality of anchors 14 that are embedded in the concrete 5. The anchor plates 13 are fitted into aperture portions 15 that have been formed in advance in the lateral liners 4, and are fixed in place by being fillet-welded into an integrated unit with the lateral liner 4. Namely, suitable places of the lateral liners 4 are partially formed by the anchor plates 13, and the hanging-side jack stands 12 are fixed to these anchor plates 13.

Note that in order to provide the hanging-side jack stands 12 on the PC wall 3 and enable them to support the jack-up units 11, alternatively, the plate thickness of the entire lateral liner 4 may be made thicker so as to ensure it has sufficient strength to support the jack-up units 11. However, in this case, it is impossible to achieve the weight and cost reductions obtained from the optimized design of the lateral liners 4. Because of this, in the present embodiment, the jack-up units 11 are supported, and the hanging-side jack stands 12 are fixed in place via the anchor plates 13 that are attached to the aperture portions 15 of the lateral liners 4 so as to increase supporting strength of certain portions.

As a result of the anchor plates 13 being provided in this manner, it becomes unnecessary to increase the overall plate thickness of the lateral liners 4 and the like so as to ensure they have sufficient strength to support the jack-up units 11, and it is possible to secure the necessary anchor points while limiting the plate thickness of the lateral liners 4 to the required minimum.

Returning to FIG. 5, next, a plurality of hanged-side jack stands 16 that correspond to the plurality of hanging-side jack stands 12 are placed on the outer circumferential edge portion of the outer tank roof 10. The hanged-side jack stands 16 are provided so as to protrude from the outer circumferential edge portion of the outer tank roof 10 substantially horizontally towards the outside of the tank. These hanged-side jack stands 16 are removably fixed to the outer circumferential edge portion of the outer tank roof 10.

Note that these hanged-side jack stands 16 may be provided above the outer tank roof 10 instead of underneath the outer tank roof 10 as is shown in FIG. 5.

The jack-up units 11 are provided extending between the hanging-side jack stands 12 and the hanged-side jack stands 16. As is shown in FIG. 5, each jack-up unit 11 is constituted as a center hole jack, and has a cylindrical jack main body 11*a* that is suspended under each hanged-side jack stand 16 and a jack-up rod 17 that vertically extends to be held on the jack main body 11*a* in a strokable way and causes an upper end thereof to be engaged with the hanging-side jack stand 12 via an equalizer 17*a*.

A plurality of the jack-up units 11 having the above-described structure are provided at predetermined intervals in the tank circumferential direction. Note that the roof stand 8 can be removed once a roof steel frame portion of the outer tank roof 10 has been assembled. Moreover, once the jack-up unit 11 has been installed as is described above, then a portion of the legged trestles 9 can also be removed. If the roof stand 8 and a portion of the legged trestles 9 are removed, then the weight of the outer tank roof 10 is supported by the plurality of jack-up units 11.

Figure 7:
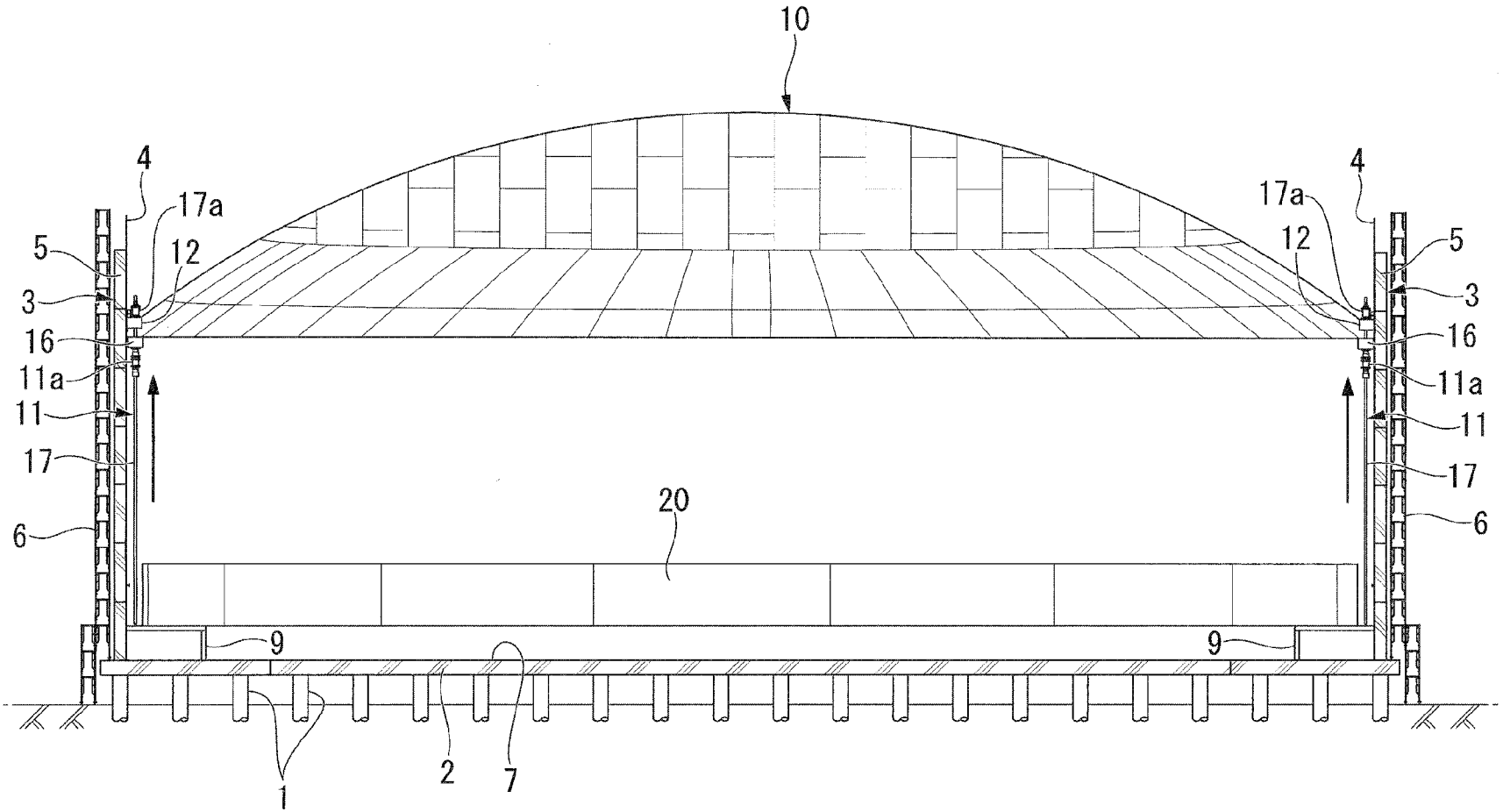
FIG. 7 is a view showing a fifth step of the construction method according to the embodiment of the present invention.

Next, as is shown in FIG. 7, the outer tank roof 10 that has been assembled on top of the base plate 2 is lifted up by the jack-up units 11. Specifically, when the jack main body 11*a* is driven in forward rotation, this jack main body 11*a* together with the hanged-side jack stand 16 is lifted up while being guided by the jack-up rod 17, and the outer tank roof 10 which is in the course of assembly is jacked up. By jacking up the outer tank roof 10, inner tank lateral plates 20 can be transported into the space underneath the outer tank roof 10, thereby securing sufficient work space to assemble the inner tank.

Figure 8:
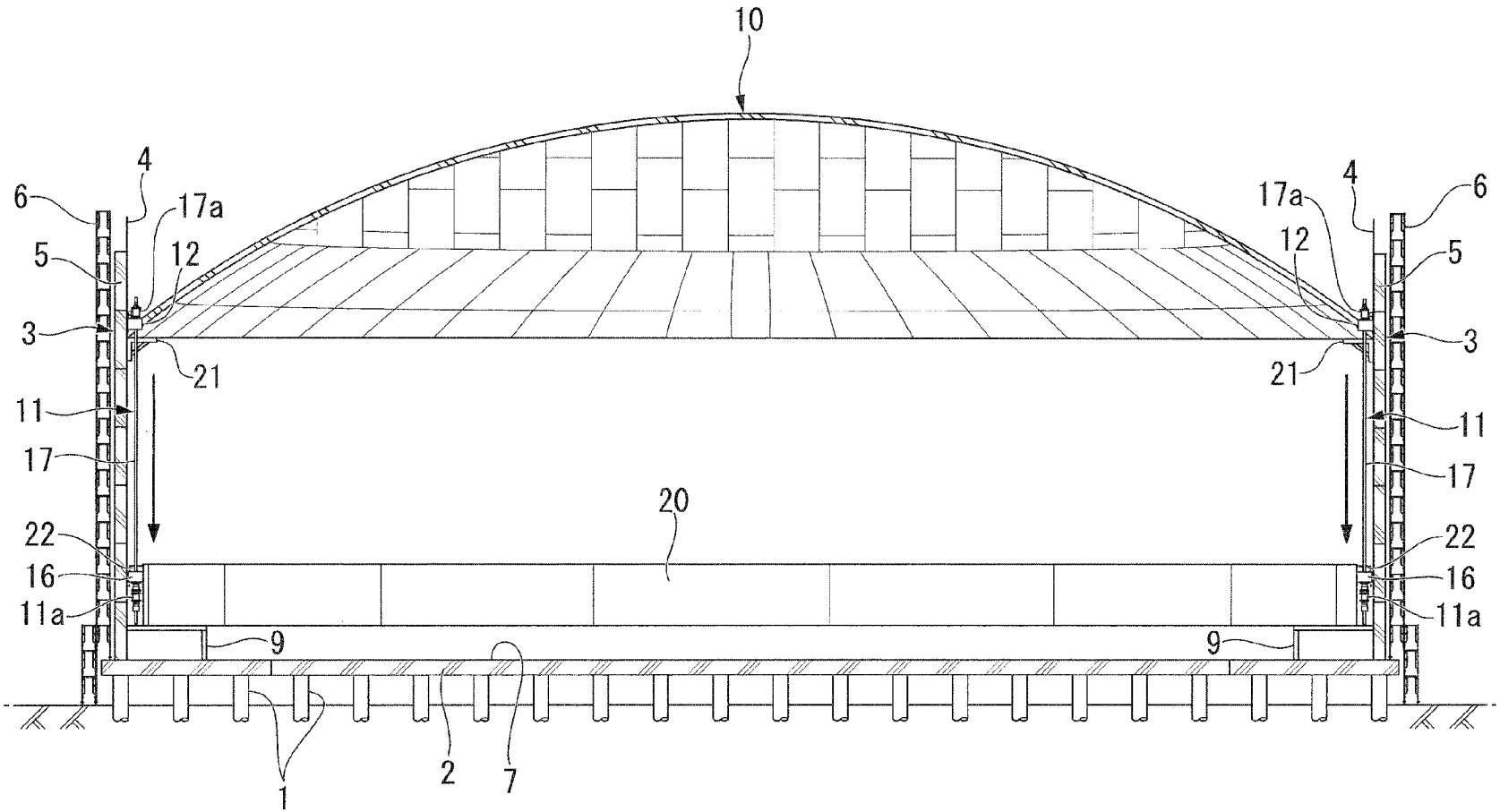
FIG. 8 is a view showing a sixth step of the construction method according to the embodiment of the present invention.

Next, as is shown in FIG. 8, the outer tank roof 10 that has been lifted up by the jack-up units 11 is held by the PC wall 3. Specifically, the outer tank roof 10 is held by the PC wall 3 via holding stands 21 that are installed in a middle stage of the PC wall 3. The holding stands 21 are installed such that they protrude at a predetermined height from the PC wall 3 substantially horizontally towards the inside of the tank. These holding stands 21 are fixed both firmly and removably to, for example, the anchor plates 13 such as that shown in FIG. 6 which have been embedded in advance in the PC wall 3.

Once the holding stands 21 have been installed, the fixing of the hanged-side jack stands 16 to the outer tank roof 10 is released. Once the fixing of the hanged-side jack stands 16 has been released, the weight of the outer tank roof 10 is supported by the holding stands 21. Once the outer tank roof 10 is being held by the PC wall 3 via the holding stands 21 in this way, the jack main bodies 11*a* are driven in reverse so that they are lowered to the vicinity of the base plate 2. The space underneath the outer tank roof 10 can be used for the task of assembling the inner tank lateral plates 20. Note that separate hanged-side jack stands 16 are mounted on the inner tank lateral plates 20, however, the hanged-side jack stands 16 used for the outer tank roof 10 may be redeployed.

As is shown in FIG. 8, when assembling the inner tank, firstly, a plurality of the inner tank lateral plates (which form the inner tank sidewall) 20 are erected on the legged trestles 9 in the tank circumferential direction. By welding together the inner tank lateral plates 20 that are mutually adjacent to each other in a horizontal direction, these inner tank lateral plates 20 are assembled in a toroidal shape. Note that the inner tank lateral plates 20 assembled here correspond to the topmost layer (i.e., to the eighth layer in the present embodiment).

Next, a plurality of hanged-side mounting stands 22 that correspond to the plurality of hanged-side jack stands 16 are installed on the inner tank lateral plates 20 that have been assembled in a toroidal shape. The hanged-side mounting trestles 22 are installed so as to protrude from the inner tank lateral plates 20 that have been assembled in a toroidal shape substantially horizontally towards the outside of the tank. The hanged-side jack stands 16 of the jack-up units 11 are removably fixed to the hanged-side mounting trestles 22. As a result, either all of or a portion of the weight of the inner tank lateral plates 20 that have been assembled in a toroidal shape is thereby supported by the jack-up units 11. Moreover, in order to prevent any deformation of the inner tank lateral plates 20, if necessary, it is preferable for a suitable reinforcing material to be provided on at least one of the inner side and the outer side of the inner tank lateral plates 20.

Figure 9:
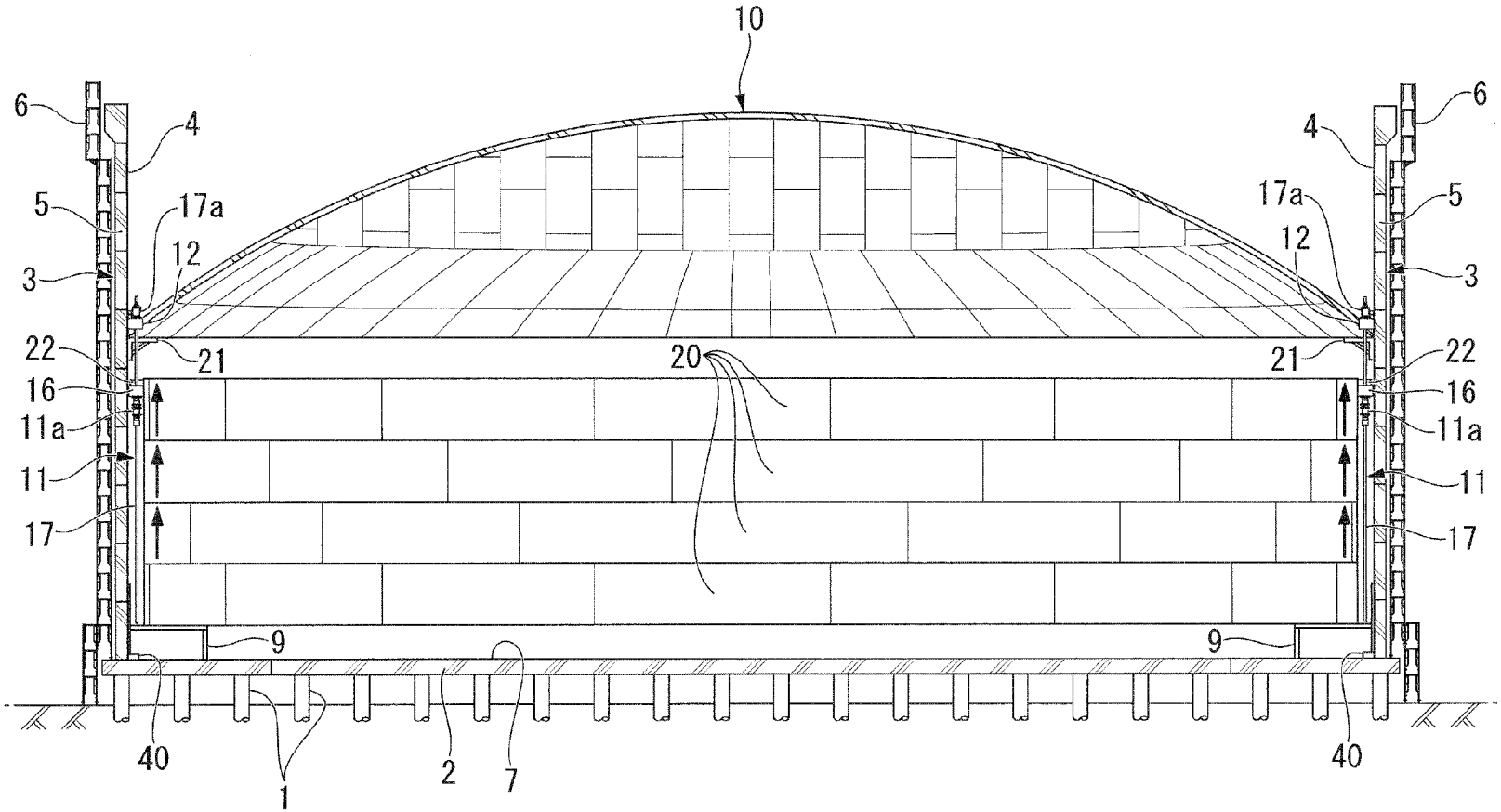
FIG. 9 is a view showing a seventh step of the construction method according to the embodiment of the present invention.

Next, as is shown in FIG. 9, the inner tank is assembled by repeating alternatingly the step of lifting the inner tank lateral plates 20 using the jack-up units 11 and the step of attaching the next inner tank lateral plates to the underside of the lifted inner tank lateral plates 20. Specifically, firstly, the inner tank lateral plates 20 that have been assembled in a toroidal shape are lifted up by the jack-up operation of the jack-up units 11 by a distance that corresponds to the vertical width of a single inner tank lateral plate 20. Next, the next inner tank lateral plates 20 are transported via a construction opening (not shown) that is provided in the PC wall 3 into the space that is formed underneath the inner tank lateral plates 20 as a result of the jack-up operation. These inner tank lateral plates 20 are lowered onto the legged trestle 9, and are positioned in a toroidal shape underneath the jacked-up inner tank lateral plates 20.

Thereafter, the plurality of inner tank lateral plates 20 that have been placed in a toroidal shaped are welded together, and by also welding together vertically adjacent inner tank lateral plates 20, these inner tank lateral plates 20 are formed into an integral cylindrical shape.

Note that the plurality of inner tank lateral plates 20 may be joined together in a horizontal direction in advance outside the tank, and be transported into the tank interior so as to form them into a toroidal shape, and vertically adjacent inner tank lateral plates 20 may be then welded together. In this way, by performing the task of joining the plurality of inner tank lateral plates 20 together outside the PC wall 3 where there are few limitations on the working space, the welding operation is made easier, and the inner tank can be assembled efficiently.

In this way, by repeating alternatingly the step of lifting the inner tank lateral plates 20 using the jack-up units 11 and the step of attaching the next inner tank lateral plates to the underside of the lifted inner tank lateral plates 20, so as to continuously add the next inner tank lateral plates 20 to the underside of the inner tank lateral plates 20, this adding on of the inner tank lateral plates 20 is performed at a low height in the vicinity of the base plate 2. Because of this, the task of assembling the inner tank can be performed safely at a low height while any obstruction from the outer tank roof 10 which is being held partway up the PC wall 3 is avoided.

In the present embodiment, in this way, the PC wall 3 is built on the outer circumferential edge portion of the base plate 2, and in parallel with this, the outer tank roof 10 is assembled on top of the base plate 2 outside the outer circumferential edge portion thereof. Once the outer tank roof 10 has been assembled to a certain stage, the outer tank roof 10 is lifted up by the jack-up units 11, and is held by the PC wall 3 which is in the course of assembly. By doing this, sufficient work space to assemble the inner tank can be secured underneath the outer tank roof 10, and the inner tank can be assembled independently of the inner tank roof 10. Accordingly, according to the present embodiment, the tasks of building the PC wall 3, assembling the outer tank roof 10, and assembling the inner tank can all be performed as simultaneous parallel tasks, and a major reduction in the construction time can be achieved.

Figure 10:
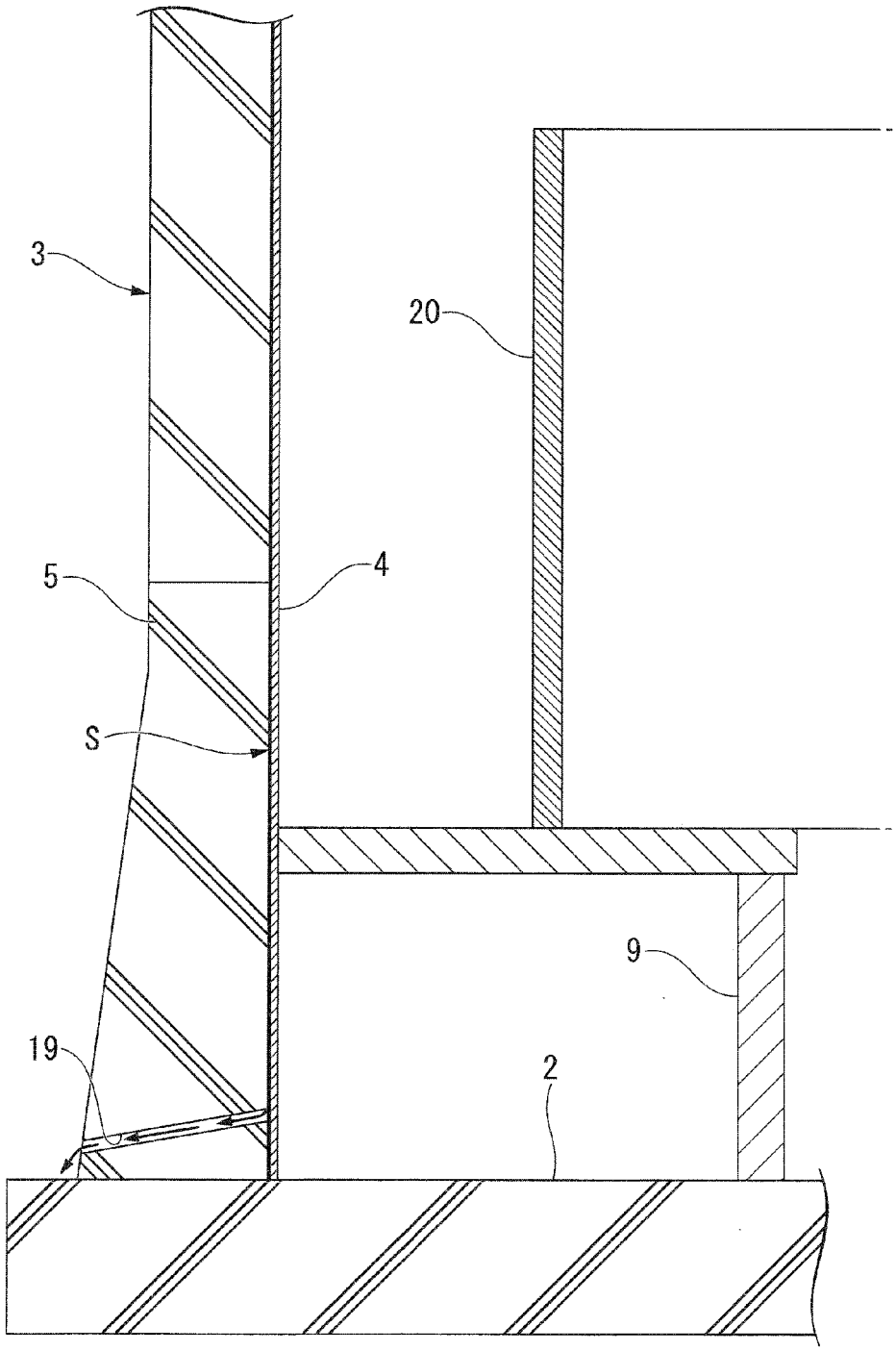
FIG. 10 is a cross-sectional view showing drainage holes according to the embodiment of the present invention.

Note that in this simultaneous parallel operation or in the steps prior thereto, because the construction of the outer tank roof 10 is not yet completed, there is a concern that moisture may become accumulated in the gap between the lateral liners 4 and the concrete 5 during the pouring of the concrete 5 of the PC wall 3, or due to precipitation during wet weather. Because of this, as is shown in FIG. 10, in the present embodiment, a drainage hole 19 that is used to drain water from the gap between the lateral liners 4 and the concrete 5 is provided in a base end portion, which serves as the foundation portion, of the PC wall 3.

In the present embodiment, the drainage hole 19 is formed so as to penetrate the concrete 5 in the thickness direction thereof It is preferable for a plurality of the drainage holes 19 to be formed at predetermined intervals in the tank circumferential direction. The drainage hole 19 is inclined so as to be lower down on the tank outer side and higher up on the tank inner side (i.e., on the lateral liner 4 side). In this embodiment, because the concrete 5 is poured using the lateral liners 4 as an inner side forming frame, an unpreventable minute gap (shown by the symbol S in FIG. 10) is generated by the drying contraction of the concrete 5 between the lateral liners 4 and the concrete 5. However, by providing the drainage hole 19 in the base end portion of the PC wall 3, water flow can be properly controlled, and any moisture that accumulates in the gap S can be allowed to drain away to the outside of the tank.

Note that the position where the drainage hole 19 is formed is preferably as close as possible to the base plate 2 in order to limit the accumulation of moisture in the gap S. For example, it is also possible to form the drainage hole 19 adjacent to the base plate 2 such that it penetrates horizontally instead of diagonally. Moreover, on the inner side of the PC wall 3, as is shown in FIG. 9, using the space underneath the legged trestles 9, thermal corner protection 40 which prevents any leakage of the tank contents is provided in a corner portion between the base plate 2 and the PC wall 3. However, until the time when the work of installing cold insulating material on the inside of this tank is begun, by forming a hole through the corner portion of the lateral liner 4 side and using this as a drainage hole, any moisture that has accumulated in the gap S may be discharged to the inside of the tank.

Figure 11:
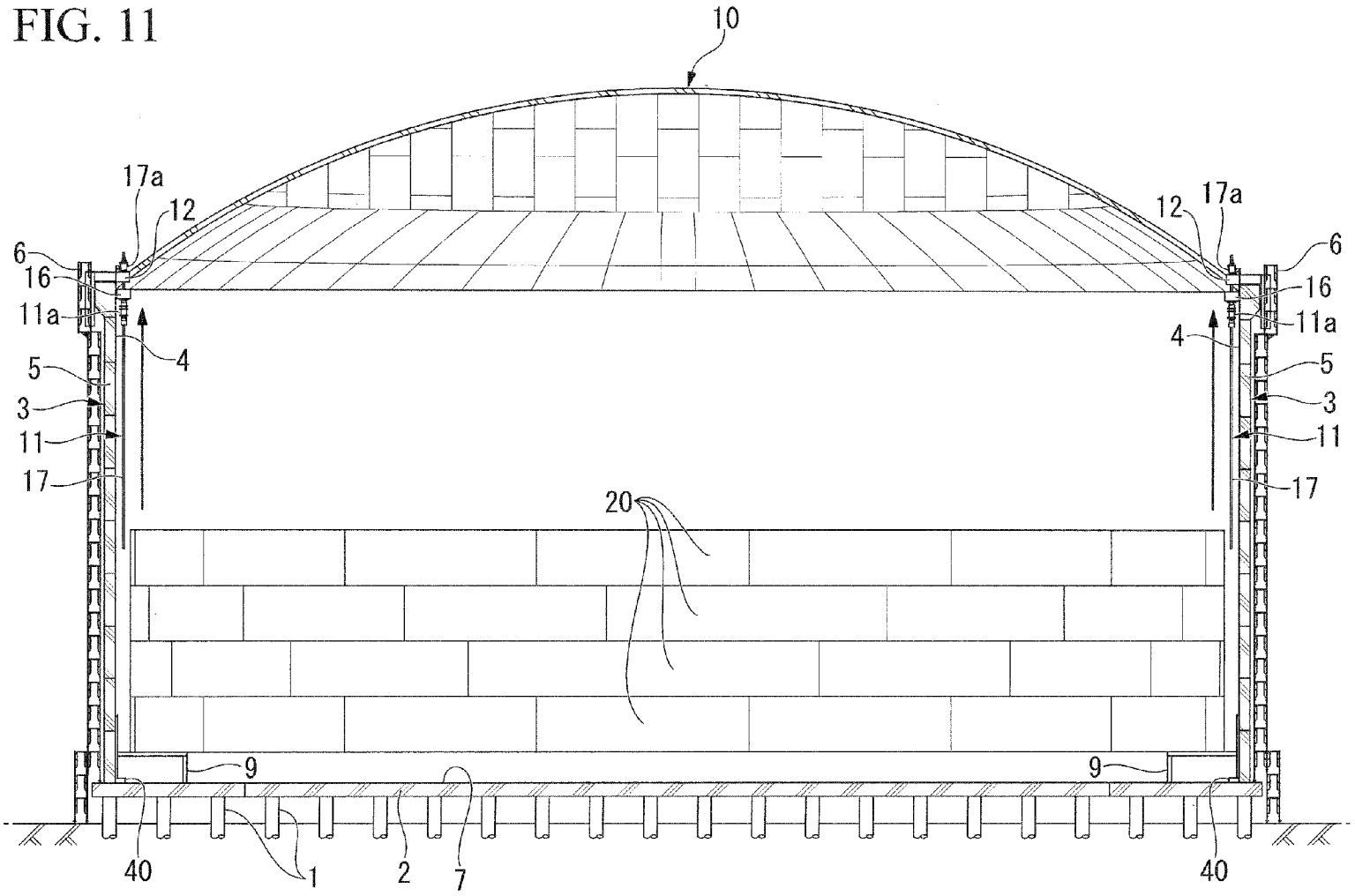
FIG. 11 is a view showing an eighth step of the construction method according to the embodiment of the present invention.

Once the building of the PC wall 3 is complete, next, as is shown in FIG. 11, the outer tank roof 10 is lifted up by the jack-up units 11 and is fixed in place on the apex of the PC wall 3. Specifically, the fixing of the hanging-side jack stands 12 to the middle stage of the PC wall 3 is released, and the hanging-side jack stands 12 are fixed via temporary stands to the apex portion of the PC wall 3. In addition, the fixing of the hanged-side jack stands 16 to the inner tank lateral plates 20 is released, and the hanged-side jack stands 16 are fixed to the outer circumferential edge portion of the outer tank roof 10. The jack-up units 11 are provided so as to extend between the hanging-side jack stands 12 and the hanged-side jack stands 16. Note that once the outer tank roof 10 has been lifted up by the jack-up units 11, the holding stands 21 are able to be removed. Consequently, the holding stands 21 are subsequently removed at the appropriate time.

Figure 12:
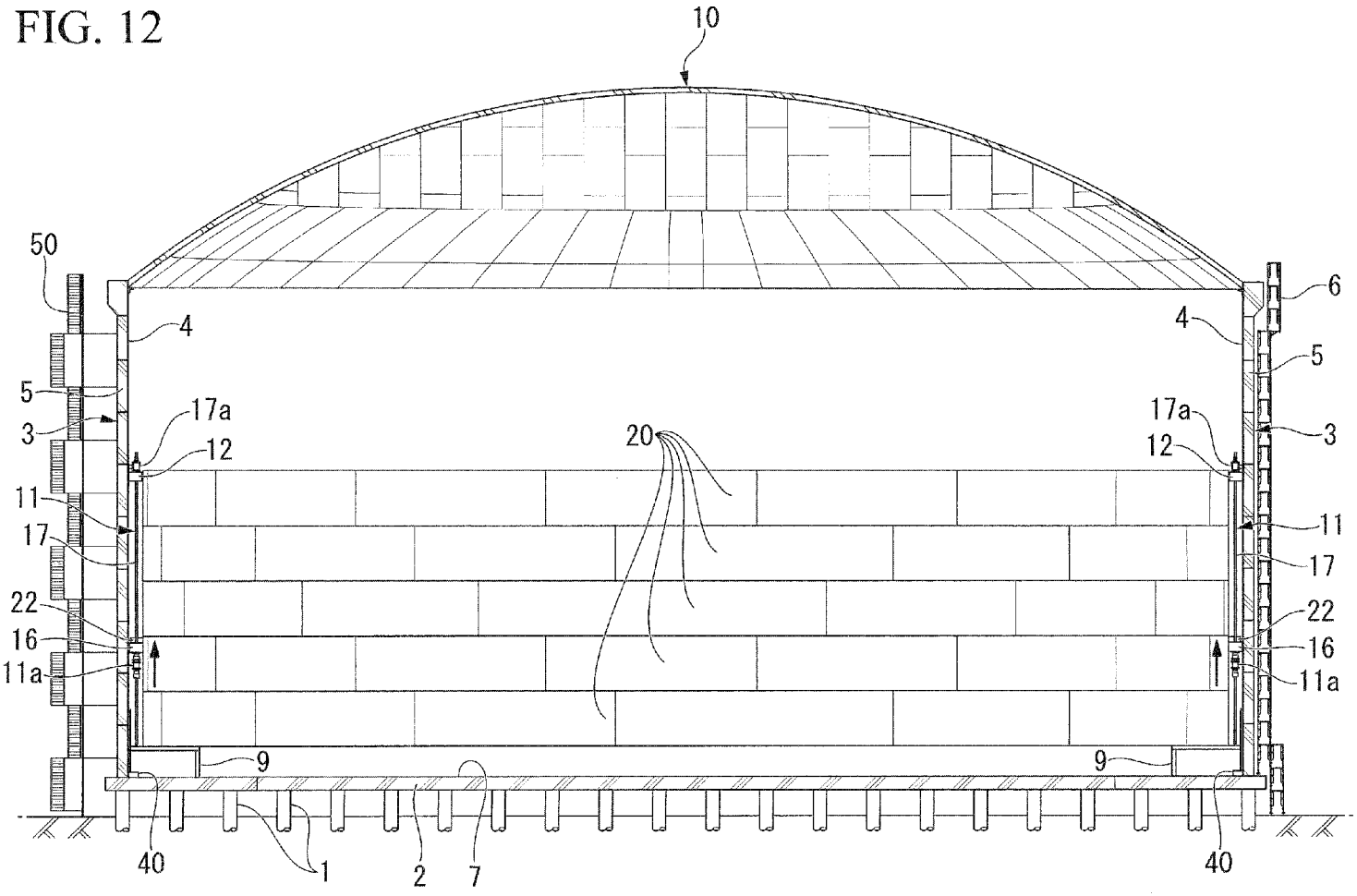
FIG. 12 is a view showing a ninth step of the construction method according to the embodiment of the present invention.

Once the outer tank roof 10 has been fixed in place on the PC wall 3, next, as is shown in FIG. 12, the jack-up units 11 are provide on a middle stage of the PC wall 3. The jack-up units 11 are then used for assembling the inner tank until the inner tank is completed. Namely, as is described above, the step of lifting the inner tank lateral plates 20 using the jack-up units 11 and the step of attaching the next inner tank lateral plates to the underside of the lifted inner tank lateral plates 20 are repeated alternatingly, so that the inner tank lateral plates 20 are assembled sequentially from the topmost stage to the bottommost stage (for a total of 8 stages in the present embodiment).

Figure 13:
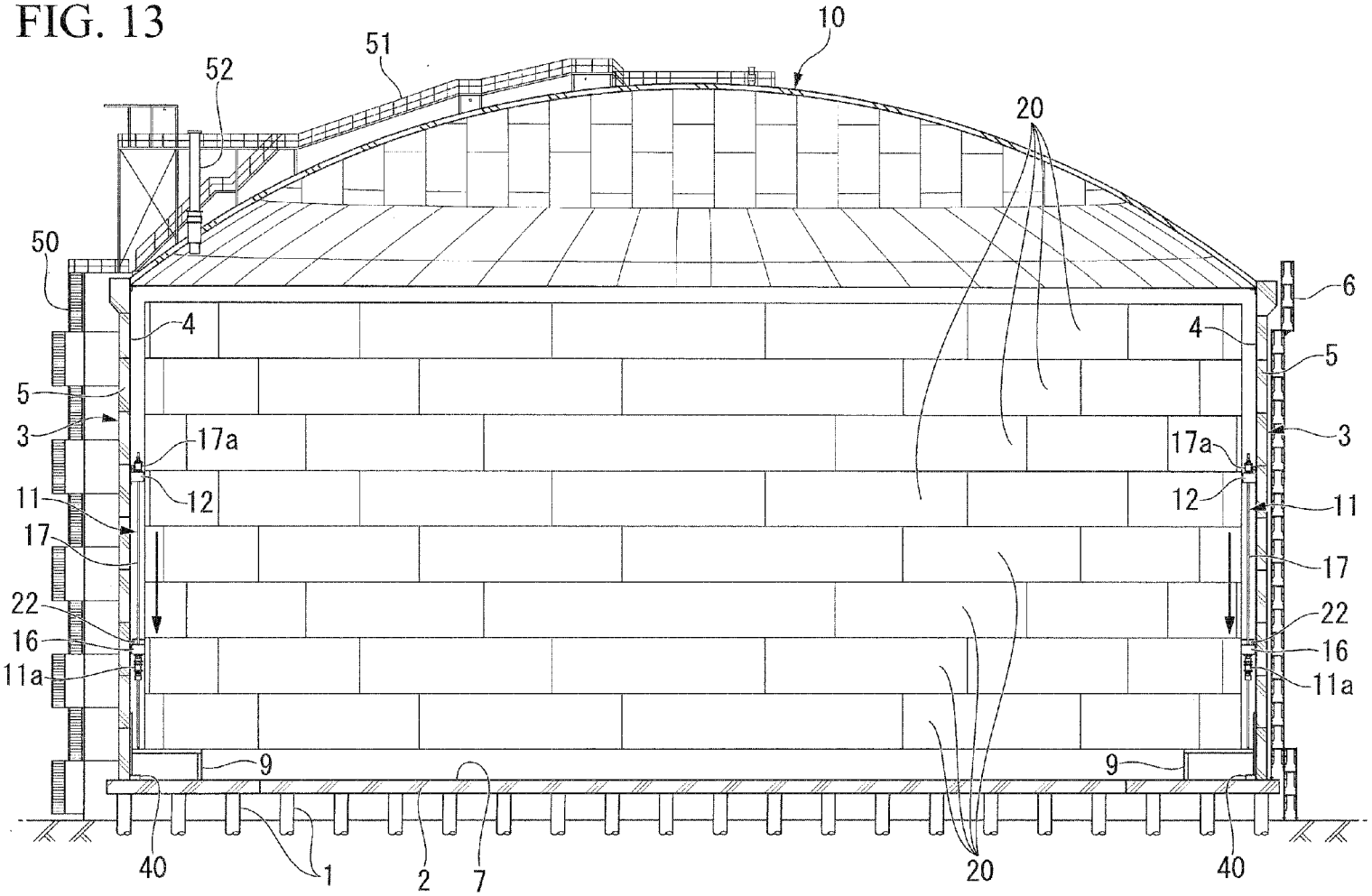
FIG. 13 is a view showing a tenth step of the construction method according to the embodiment of the present invention.

As is shown in FIG. 13, once the assembly of the inner tank has been completed, the inner tank is lowered onto a predetermined position on the base plate 2.

Note that it is also possible to alter the position where the hanged-side jack stands 16 are connected to the inner tank lateral plates 20 to a lower position. The reason for this is that it is possible for the inner tank to be lowered precisely onto a predetermined position on the base plate 2 in the following step. Moreover, the plate thickness of the inner tank lateral plates 20 on the lower stages is made thicker so as withstand the comparatively greater liquid pressure from the liquid contents which is filled after the tank has been completed, and the plate thickness of the inner tank lateral plates 20 on the upper stages (particularly the topmost stage) is made thinner as it only has to withstand a comparatively lower liquid pressure from the liquid contents. Because of this, connecting the hanged-side jack stands 16 to the lower part of the inner tank lateral plates 20 provides advantages regarding strength.

Figure 14:
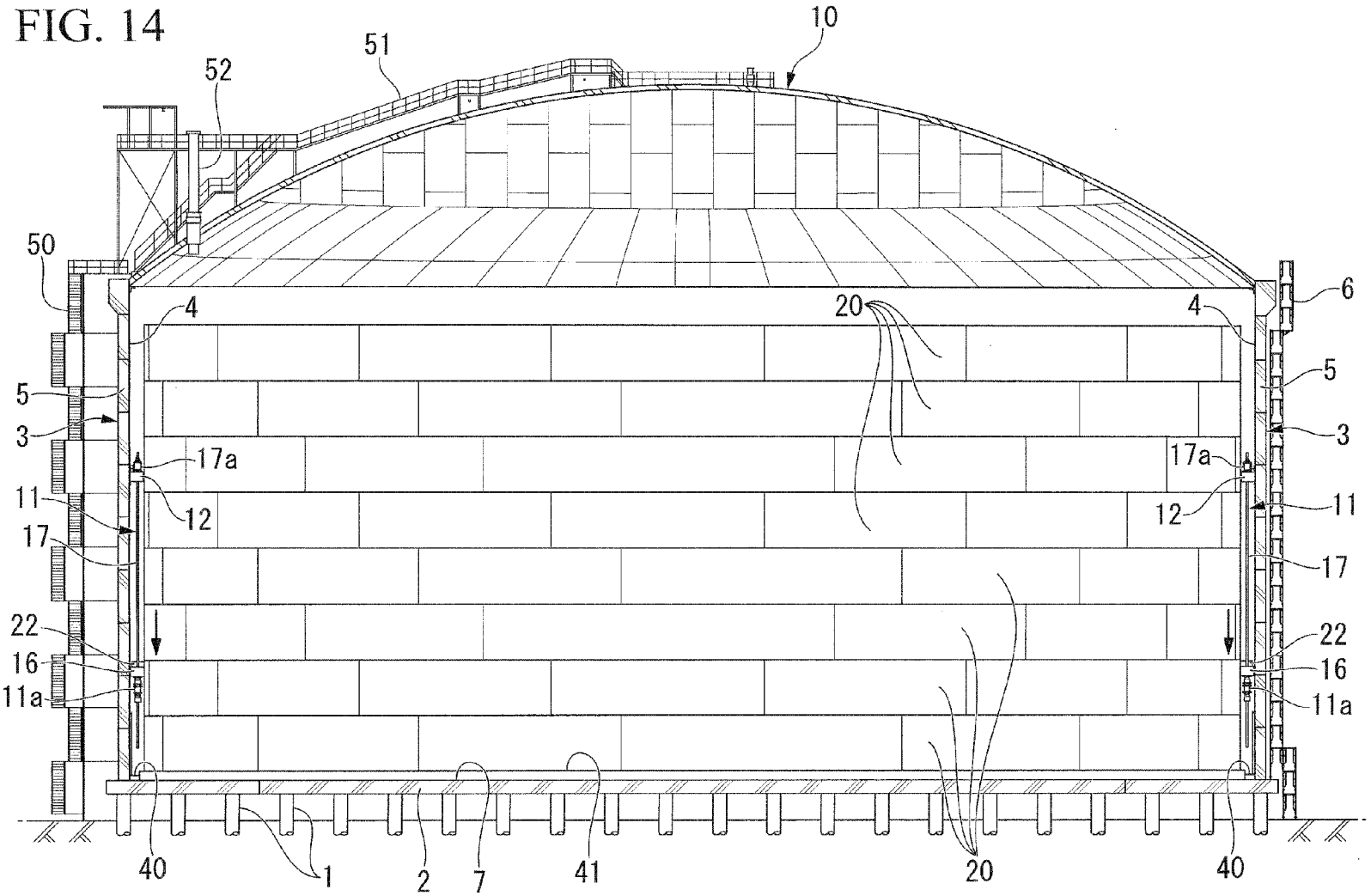
FIG. 14 is a view showing an eleventh step of the construction method according to the embodiment of the present invention.

Next, as is shown in FIG. 14, the legged trestles 9 are removed, and cold insulation construction is performed by laying cold insulating material 41 on top of the base plate 2. The cold insulating material 41 is formed by, for example, providing foam glass on top of a bottom portion cold resistance moderating material that has been laid on top of the base plate 2, and by providing rigid lightweight aerated concrete, perlite concrete blocks, or structural lightweight concrete blocks or the like at the positions onto which the inner tank will be lowered, and then laying an inner tank bottom plate on top thereof Once the construction of the cold insulation on the base plate 2 has ended, the inner tank is lowered onto the base plate 2 by the jack-up units 11. When the inner tank has been lowered, the jack-up units 11 are removed.

Ascending stairs 50 are provided around the PC wall 3, and an on-roof structure 51 and barrel nozzle 52 and the like are provided on the outer tank roof 10. Concrete is poured over the outer tank roof 10. After the concrete has been poured over the outer tank roof 10, the drainage hole 19 (see FIG. 10), which is no longer necessary, is blocked off.

Thereafter, tensioning work is performed on the PC wall 3. In addition, after a pump barrel 53 has been installed, and the inner tank construction opening (not shown) has been closed off, a pressure resistance/air-tightness test is performed by filling the tank with water. Note that, normally, the installation of the pump barrel 53 is performed prior to the closing off of the inner tank construction opening, however, this installation can be set to any desired point in time.

Figure 15:
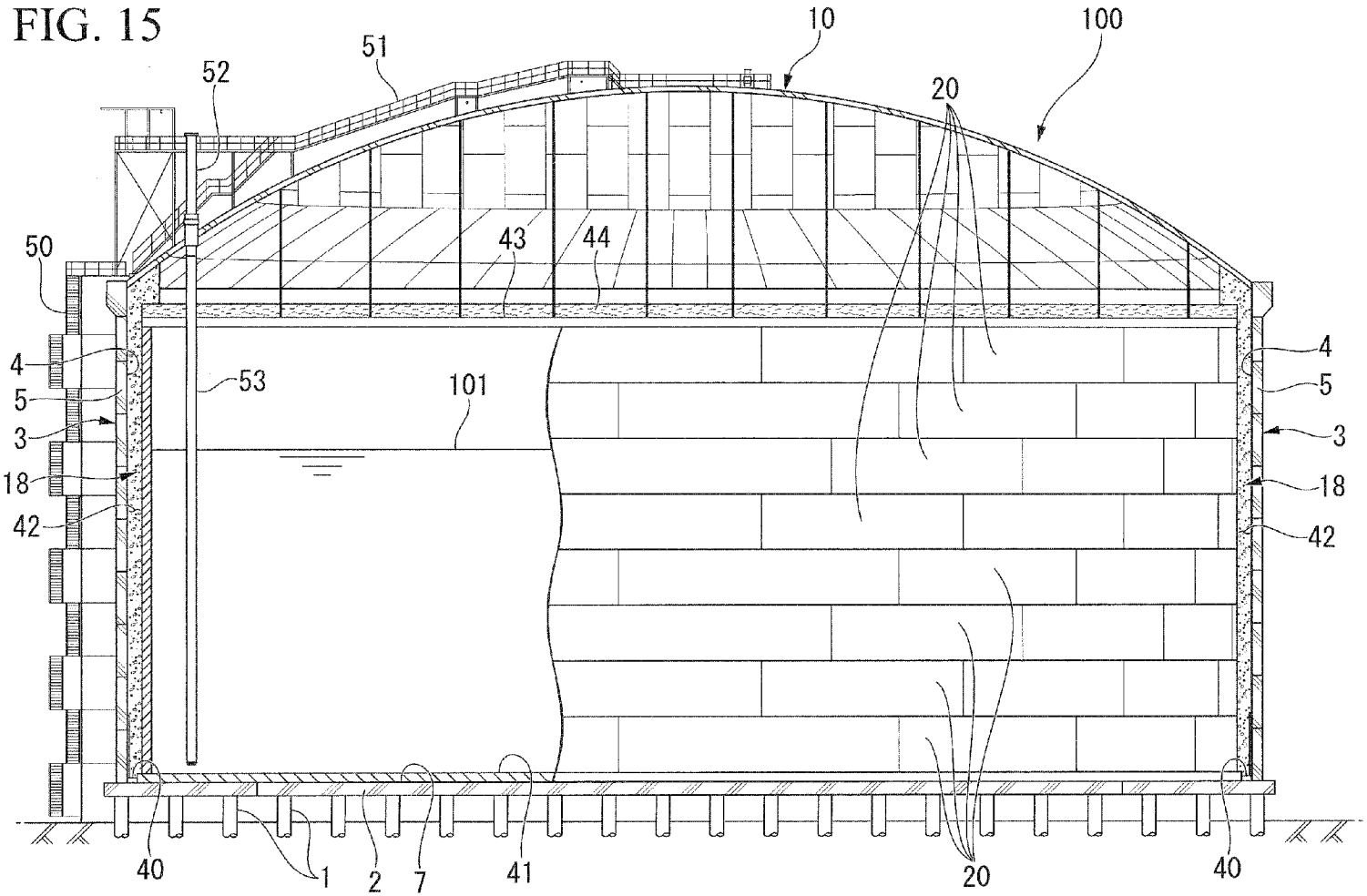
FIG. 15 is a view showing a twelfth step of the construction method according to the embodiment of the present invention.

Lastly, as is shown in FIG. 15, work is performed in order to insulate a gap 18 between the inner and outer tanks by filling the gap 18 with a cold insulating material 42 (for example, with perlite). Moreover, work is also performed to insulate the roof underside by laying a cold insulating material 44 (for example, glass wool) on a suspension deck 43 that has been provided on the underside of the outer tank roof 10.

Thereafter, painting work and pipe insulating work and the like are performed, and the construction of the cylindrical tank 100 designed to contain LNG 101 is completed.

In this way, the method of constructing a cylindrical tank 100 that has a metal inner tank and a concrete outer tank according to the above-described present embodiment has a step of building a PC wall 3 by erecting the lateral liners 4 sequentially from the bottommost layer to the topmost layer on the outer circumferential edge portion of the base plate 2, and pouring the concrete 5 so as to follow the erecting of the lateral liners 4 with the lateral liners 4 being used as an inner side forming frame. As a result, because the erecting of the lateral liners 4 and the pouring of the concrete 5 are parallel tasks that are performed at fixed intervals, and the height of the protruding portion X of the lateral liners 4 where the concrete 5 has not yet been poured can be restricted to a fixed range, it is possible to prevent any buckling of the lateral liners 4 due to wind loading. Moreover, by employing this method, when designing the lateral liners 4, it is possible to optimize the plate thickness and the like thereof so as to limit the quantities of the materials required for construction to the necessary minimum. Accordingly, according to the present embodiment, it is possible to obtain a method of constructing a cylindrical tank 100 in which the quantities of the materials required for construction is kept to the necessary minimum while any buckling of the lateral liners 4 is prevented.

Moreover, in the present embodiment, by employing a step of alternatively performing a butt-welding of the next lateral liner 4 onto a top of the lateral liner 4 which has been erected with the pouring of the concrete 5 up to a height where the concrete 5 covers the butt-welded portion, the height of the protruding portion X of the lateral liners 4 where the concrete 5 has not yet been poured can be restricted to a fixed range, and because the weld line 4*b*, which is the portion where the lateral liners 4 are welded together, are sequentially covered by the concrete 5, any buckling of the lateral liners 4 that is caused by wind loading can be even more reliably prevented.

Moreover, in the present embodiment, by employing a step of providing a drainage hole 19, which is used to drain water from a gap between the lateral liners 4 and the concrete 5, in the base end portion of the PC wall 3, even if an unpreventable minute gap is generated between the lateral liners 4 and the concrete 5 by the drying contraction of the concrete 5, and before the outer tank roof 10 is installed, moisture becomes accumulated in this gap during the pouring of the concrete 5, or due to precipitation during wet weather, this water flow can be properly controlled, and any moisture can be allowed to drain away through the drainage hole 19 in the base end portion of the PC wall 3.

Moreover, in the present embodiment, by employing a step of assembling the inner tank by repeating alternatingly the lifting of the inner tank lateral plate 20 using the jack-up unit 11 and the attaching of the next inner tank lateral plate 20 to the underside of the lifted inner tank lateral plate 20, the adding of the inner tank lateral plates 20 can be performed at a low height. Because of this, the task of assembling the inner tank can be performed safely at a low height while any obstruction from the outer tank roof 10 which is being held at the middle stage of the PC wall 3 is avoided.

Moreover, in the present embodiment, by building the PC wall 3 by pouring concrete using the lateral liners 4 as an inner side forming frame, and employing: a step of forming in advance the aperture portion 15 in the outer tank lateral plate 4; a step of mounting the anchor plate 13, to which the anchor 14 that has been embedded in the concrete is connected, in the aperture portion 15; and a step of supporting the jack-up unit 11 via the anchor plate 13 mounted in the aperture portion 15, it becomes unnecessary to increase the plate thickness of the lateral liners 4 and the like so as to ensure they have sufficient strength to support the jack-up units 11, and it is possible to secure the necessary anchor points while limiting the plate thickness of the lateral liners 4 to the necessary minimum.

While the preferred embodiment of the present invention has been described with reference to the drawings, the present invention is not limited to the aforementioned embodiment. All shapes and combinations of the means and each component shown in the aforementioned embodiment are only examples and may be variously modified based on design requirements without deviation from the gist of the present invention.

For example, in the above-described embodiment, an example is described in which the welding of the lateral liners 4 and the pouring of the concrete 5 are performed alternatingly, however, the same effects as in the above-described embodiment can also be obtained even if the welding of the lateral liners 4 and the pouring of the concrete 5 are performed as simultaneous parallel tasks at fixed intervals.

Figure 16:
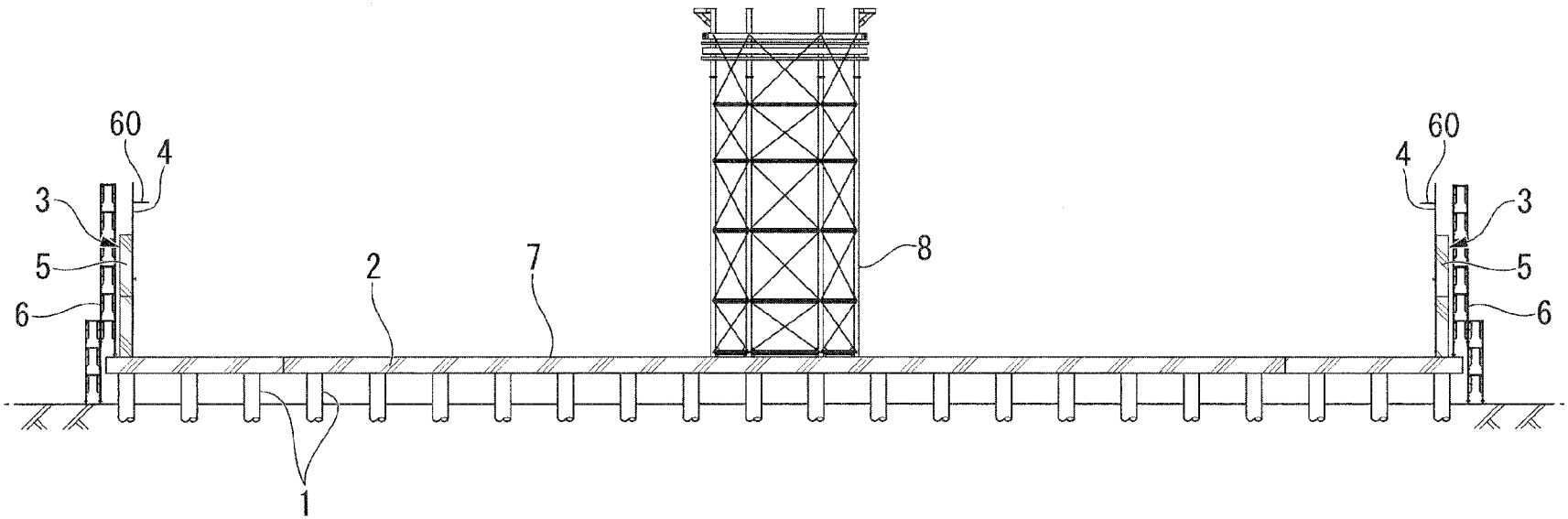
FIG. 16 is a view showing a second step of a construction method according to another embodiment of the present invention.

Furthermore, for example, in the above-described embodiment, an example is described in which the concrete 5 is poured immediately after the erecting of a layer of lateral liners 4, however, as is shown in another embodiment shown in FIG. 16, it is preferable for a stiffener 60 that is designed to withstand wind-loading to be provided on the lateral liners 4. The stiffener 60 is a temporary reinforcing component that can be removed after the concrete has been poured. The stiffener 60 is formed, for example, by forming a reinforcing component having a thickness of 6 mm and a width of 300 mm into a ring shape. The stiffener 60 is provided on the lateral liner 4 so as to protrude towards the inside of the lateral liner 4, and is preferably positioned corresponding to a portion (i.e., the protruding portion X in FIG. 3) of the lateral liner 4 that is erected first. According to this technique, because the lateral liners 4 are reinforced by the stiffener 60 in addition to the reinforcement by restricting the protruding portion X due to the pouring of the concrete 5 which is performed so as to follow the erecting of each layer of the lateral liners 4, it is possible to more reliably prevent any buckling that is caused by wind-loading.

Moreover, for example, in the above-described embodiment, an example is described in which the building of the PC wall 3, the assembling of the outer tank roof 10, and the assembling of the inner tank are performed as simultaneous parallel tasks, however, because a work space above the base plate 2 is secured by the legged trestles 9, the cold insulation work for the bottom portion may also be performed on the base plate 2 as a simultaneous parallel task.

Moreover, for example, in the above-described embodiment, an example is described of a technique in which the outer tank roof 10 is lifted up by the jack-up units 11, however, the type of jack-up unit 11 is not limited to this, and for example, a type in which the positional relationship between the jack main body 11*a* and the equalizer 17*a* is vertically opposite to this may be used.

Moreover, for example, in the above-described embodiment, an example is described of a technique in which the inner tank lateral plates 20 are lifted up by the jack-up units 11, however, for example, the type of jack-up unit 11 may be changed to one that pushes up the inner tank lateral plates 20. According to this structure, by providing just one set of jack-up units 11 for lifting up the outer tank roof 10, and redeploying this set when a plurality of cylindrical tanks 100 are being constructed, it is possible to reduce the number of jack-up units 11 that are required.

Moreover, for example, in the above-described embodiment, an example is described in which the outer tank roof 10 which is in the course of assembly is jacked up and held at a middle stage of the PC wall 3, however, for example, the suspension deck 43, the on-roof structure 51 and the barrel nozzle 52 may be assembled to the outer tank roof 10 on top of the base plate 2, and the nearly completed outer tank roof 10 may be jacked up and held at a middle stage of the PC wall 3.

Moreover, for example, in the above-described embodiment, an example is described in which the outer tank roof 10 and the like is supported by the jack-up units 11 which are provided via the anchor plates 13, however, for example, depending on the size of the load being supported, instead of providing the aperture portions, adequate reaction force for supporting the outer tank roof 10 and the like may be secured by inserting additional concrete studs into the lateral liners 4 so that the load of the outer tank roof 10 and the like is carried on supports that are equipped with stays or the like.

Moreover, for example, in the above-described embodiment, the jack-up units 11 are used for jacking up both the outer tank roof 10 and the inner tank lateral plates 20, however, dedicated jack-up units may be used respectively for each of these. Note that if dedicated jack-up units are used, then it is essentially unnecessary for the installation position of the jack-up units to be altered as is the case in the above-described embodiment. However, because the number of apparatuses increases, it is preferable for the most suitable method to be selected based on the scale of circular tank 100 being constructed.

INDUSTRIAL APPLICABILITY

According to the present invention, it is possible to obtain a method of constructing a cylindrical tank that makes it possible to limit the quantities of materials required for construction to the necessary minimum while any buckling of the outer tank lateral plates can be prevented.

REFERENCE SIGNS LIST

2: Base plate (Outer tank bottom portion)
3: PC wall (Outer tank sidewall)
4: Lateral liner (Outer tank lateral plate)
5: Concrete
11: Jack-up unit
13: Anchor plate (Anchor portion)
14: Anchor
15: Aperture portion
19: Drainage hole
20: Inner tank lateral plate
60: Stiffener
100: Cylindrical tank
S: Gap
X: Protruding portion

The invention claimed is:

1. A method of constructing a cylindrical tank that has an inner tank made of metal and an outer tank made of concrete, the method comprising:

a step of building a sidewall of the outer tank by erecting outer tank lateral plates sequentially from a bottommost layer to a topmost layer on an outer circumferential edge portion of a bottom portion of the outer tank, and pouring concrete so as to follow the erecting of the outer tank lateral plates with the outer tank lateral plates being used as an inner side forming frame; and a step of alternating between performing (i) a butt-welding of a next one of the outer tank lateral plates onto a top of the outer tank lateral plate which has been erected and (ii) pouring of the concrete up to a height where the concrete covers a portion where the butt-welding has been performed, (i) the butt-welding and (ii) pouring of the concrete being performed sequentially and a plurality of times.

2. The method of constructing a cylindrical tank according to claim 1, further comprising a step of providing a drainage hole, which is used to drain water from a gap between the outer tank lateral plates and the concrete, in a base end portion of the sidewall of the outer tank.

3. The method of constructing a cylindrical tank according to claim 1, further comprising a step of assembling the inner tank by repeating alternatingly a lifting of an inner tank lateral plate using a jack-up unit and the attaching of a next inner tank lateral plate to an underside of the inner tank lateral plate which is lifted by the jack-up unit.

4. The method of constructing a cylindrical tank according to claim 3, further comprising:

a step of forming in advance an aperture portion in the outer tank lateral plate;

a step of mounting an anchor portion, to which an anchor that has been embedded in the concrete is connected, in the aperture portion; and a step of supporting the jack-up unit via the anchor portion mounted in the aperture portion.

5. The method of constructing a cylindrical tank according to claim 1, further including providing a toroidal stiffener that protrudes inwardly from the outer tank lateral plate towards an inside of the cylindrical tank.

6. The method of constructing a cylindrical tank according to claim 1, wherein the pouring of the concrete includes a first pouring step after the bottommost layer of lateral plates has been erected, and after said first pouring step at least one additional layer of lateral plates is erected followed by further pouring of concrete in a second pouring step, and wherein the topmost layer of lateral plates is erected after the second pouring step.

7. The method of constructing a cylindrical tank according to claim 6, further including providing a stiffener on the at least one additional layer of lateral plates prior to said second pouring step, and removing said stiffener after said second pouring step.

8. The method of constructing a cylindrical tank according to claim 6, further including, during the second pouring step, pouring concrete to a level such that an amount of a highest point of a highest outer tank lateral plate extends above concrete poured in the second pouring step and does not exceed a height dimension of said highest outer tank lateral plate.

9. The method according to claim 1, further comprising installing external scaffolding to follow the erecting of the outer tank lateral plates.

* * * * *